US006206615B1

(12) United States Patent
Adsbøll

(10) Patent No.: US 6,206,615 B1
(45) Date of Patent: Mar. 27, 2001

(54) METHOD FOR FOUNDING OF A BUILDING-OR PLANT-CONSTRUCTION AND APPARATUS FOR THE USE OF THE METHOD

(75) Inventor: Bjarne Adsbøll, Kolding (DK)

(73) Assignee: Adsboll Fundering A/S, Kolding (DK)

( * ) Notice: Subject to any disclaimer, the term of this patent is extended or adjusted under 35 U.S.C. 154(b) by 0 days.

(21) Appl. No.: 09/242,815

(22) PCT Filed: Aug. 26, 1997

(86) PCT No.: PCT/DK97/00349

§ 371 Date: Feb. 25, 1999

§ 102(e) Date: Feb. 25, 1999

(87) PCT Pub. No.: WO98/09024

PCT Pub. Date: Mar. 5, 1998

(30) Foreign Application Priority Data

Aug. 26, 1996 (DK) ..... 0890/96

(51) Int. Cl.[7] ..... E02D 5/38; E02D 5/52; E02D 7/00

(52) U.S. Cl. ..... 405/230; 52/293.1; 52/741.15; 52/742.14

(58) Field of Search ..... 405/230, 233; 52/293.1, 294, 514.5, 741.15, 742.14, 742.16, 745.17

(56) References Cited

U.S. PATENT DOCUMENTS

| | | | | |
|---|---|---|---|---|
| 3,726,950 | * | 4/1973 | Turzillo | 52/742.14 X |
| 4,083,191 | * | 4/1978 | Donnelly | 405/230 |
| 4,255,071 | * | 3/1981 | Koppers et al. | 52/741.15 X |
| 4,338,047 | * | 7/1982 | David | 405/230 |
| 4,787,779 | * | 11/1988 | Clark | 405/230 |
| 4,938,634 | * | 7/1990 | Lee | 52/294 X |
| 4,995,204 | * | 2/1991 | Kelso | 405/230 X |
| 5,116,355 | * | 5/1992 | Freeman, III | 405/230 |
| 5,575,591 | * | 11/1996 | Vanderklaauw | 405/230 |

FOREIGN PATENT DOCUMENTS

| | | |
|---|---|---|
| 675000 | 8/1990 | (CH) . |
| 135539 | 1/1977 | (NO) . |
| 346133 | 6/1972 | (SE) . |
| 400595 | 4/1978 | (SE) . |

* cited by examiner

*Primary Examiner*—Carl D. Friedman
*Assistant Examiner*—Kevin D. Wilkens
(74) *Attorney, Agent, or Firm*—Ladas & Parry

(57) ABSTRACT

A method and an apparatus primarily for laying a foundation for existing building structures. The method and the apparatus are primarily directed to the re-establishment of sufficient support in combination with foundation piles that no longer offer the sufficient support. E.g. this problem may arise in connection with wooden foundation piles in which an upper part of the foundation pile is rotten due to a sinking of the groundwater level. The method comprises removal of the upper part of the foundation pile and establishment of a support between a remaining foundation pile and a foundation on a building structure. The support is established in the aforementionned primary application by casting a fluid, preferably a curable casting material, in a telecospic cylinder, which is positioned between the remaining foundation pile and the foundation of the building structure. Using a cylinder for casting the casting material it is possible to maintain a sufficient pressure in the casting material both during pumping of the casting material into the cylinder and during casting material curing.

4 Claims, 4 Drawing Sheets

METHOD FOR FOUNDING OF A BUILDING-OR PLANT-CONSTRUCTION AND APPARATUS FOR THE USE OF THE METHOD

BACKGROUND OF THE INVENTION

The present invention relates to a method for laying a foundation for an existing building structure, said method comprising establishment of a distance between a foundation of the building structure and a foundation pile with an upper pan providing a carrier surface on the foundation pile and establishment of a core between the carrier surface on the foundation pile and a carrier surface on the foundation, and where the core between the carrier surface on the foundation and the carrier surface of the foundation pile is a cast core, that the fluid for establishing the cast core is a curable casting material, that the curable casting material is let into the cylinder under pressure, that the cylinder is filled with the curable casting material under pressure and a pressure of the fluid is established in the cylinder until the top piston and the bottom piston are situated in their respective positions, and that the curable casting material is cured.

A preferred application of the method relates to a further method for laying a foundation for an existing building structure, said method comprising excavation under an existing foundation, removal of the upper part of an existing foundation pile to provide a carrier surface on a remaining foundation pile and establishment of a core between the carrier surface on the remaining foundation pile and a carrier surface on the remaining foundation, and where the core between the carrier surface on the foundation and the carrier surface of the foundation pile is a cast core, that the fluid is a curable casting material, that the curable casting material is let into the cylinder under pressure, that the cylinder is filled with the curable casting material under pressure until the top piston and the bottom piston are situated in their respective positions, and that the curable casting material is cured.

The present invention also relates to an apparatus comprising a cylinder with a number of pistons, preferably a top piston and a bottom piston, which pistons are telescopically displaceable in relation to one another, preferably that the top piston is telescopically displaceable in relation to the bottom piston, and where at legs one of the pistons is provided with an inlet for a fluid.

In connection with foundation piles, mostly of wood, there may occur rot in the upper part of the foundation pile in connection with a lowering of the groundwater level. This deteriorates or completely removes the carrying capacity of the foundation pile. With a method as discussed above it is possible to re-establish the carrying capacity of the foundation pile.

CH 675 000 describes a method of the above-mentioned type. Prior to removal of an upper part of the foundation pile, a shoring is arranged around the upper part. The shoring extends from the existing foundation down to a part of the foundation pile that will remain after the upper part has been removed. The shoring comprises wooden beams contacting an under side of the existing foundation. Support plates on either side of the remaining foundation pile extend from the wooden beams downward and are fastened to the remaining foundation pile by means of bolts extending between the support plates. A separation plate is displaced perpendicularly in relation to the remaining foundation pile and separates the upper part to be removed from the remaining foundation pile. The upper part is then removed between the support plates. Reinforcements are hammered down into the remaining foundation pile and concrete is cast in the space where the upper part of the foundation pile was previously found.

The method and the apparatus disclosed in the above document involve important drawbacks, however. The initial handling in connection with positioning of wooden beams, support plates and bolts is very comprehensive. Subsequent removal of the upper part of the foundation pile is extremely difficult due to the poor access resulting from support plates and bolts. Final positioning of reinforcements and casting of concrete is also made difficult by support plates and bolts. Besides, it is not possible to establish a support having sufficient carrying capacity due to settling of the cast concrete when the support plates are removed at last. The time that needs to be scheduled to establish the new support is furthermore very important.

SE 346 133 describes a further development compared to the method described in CH 675 000. A telescopic cylinder is provided for adjusting the level of a building or a part of a building. The building or building part may be a foundation or load bars in a building. The building is levelled in relation to the ground or the building part is levelled in relation to a foundation of a building. The adjustment is performed by pumping a fluid into the cylinder. The fluid may be a curable fluid such as cement. The fluid is pumped into the cylinder until the building in relation to the ground or the building part in relation to the foundation of the building has obtained the correct level as desired.

This technique is possible to use if the ground is very solid such as rock which is the ground material of Bromma just outside Stockholm in Sweden where the inventor of the prior art of SE 346 133 is living. Also, if the foundation of the building structure is already at place at the correct level it is easy afterwards to use this prior art to level building parts in relation to the foundation. However, if the ground is not very solid, the technique of SE 346 133 is not possible to use, as the cylinder would just penetrate the ground surface without being able to level the building foundation. If foundation piles is used, also the tecnique of SE 346 133 is not possible to use, because the pressure in the cylinder would just cause the foundation pile to sink and thereby penetrate further down into the ground leaving the foundation pile to be of no use at all.

It is the object of the present invention to disclose a method and to provide an apparatus for use by the method not possessing the above-mentioned many disadvantages and thereby making it possible to use cylinders with fluid under pressure in connection with foundations for building structures which are supported by foundation piles.

This object is obtained by a method that is characterised in that a cylinder is arranged between the carrier surface on the foundation pile and the carrier surface on the foundation with a top piston directed towards the carrier surface on the foundation and a bottom piston directed towards the carrier surface on the foundation pile, that the cylinder is filled with the fluid under pressure until the top piston is in contact with a carrier surface on the foundation and until the bottom piston is in contact with the carrier surface on the foundation pile said pressure established in the cylinder being greater than the pressure by gravity of the building structure on the foundation pile and being smaller than the largest possible load of pressure that the foundation pile is able to assimilate without sinking.

A preferred application of the method is for laying a foundation for an existing building structure, said method comprising excavation under an existing foundation, removal of the upper part of an existing foundation pile to provide a carrier surface on a remaining foundation pile and establishment of a core between the carrier surface on the remaining foundation pile and a carrier surface on the remaining foundation, and is characterised in that a cylinder is arranged between the carrier surface on the remaining foundation pile and the carrier surface on the existing foundation with a top piston directed towards the carrier surface on the existing foundation and a bottom piston directed towards the carrier surface on the remaining foundation pile, that a fluid under pressure is let into the cylinder, that the cylinder is filled with the fluid under pressure until the top piston is in contact with a carrier surface on the existing foundation and until the bottom piston is in contact with the carrier surface on the remaining foundation pile.

An apparatus for use by the method is characterised in that the inlet is provided with a valve, and that the valve is able to adjust the pressure of the fluid being pumped into the cylinder depending on maintaining the level of a building structure abutting the top piston and depending on avoiding sinking of a foundation pile the upper part of which abutting the bottom piston.

The method according to the invention makes it possible first to provide a support that will not settle and, second, to provide a support that will prevent the foundation pile to sink, and, third, to provide this support within a short time. The method is able to use different kinds of curable fluids as cores in the cylinder such as a casting material, e.g. of concrete. In far most cases the fluid is an incompressible fluid.

Non-curable fluids may be applied in order to level e.g. an existing building foundation. Such levelling may take a long time before it has been made sure that a stable situation has been established. Levelling may also take place over a longer period in areas where the foundation means is very unstable. Levelling may take place by positioning a number of cylinders according to the invention under e.g. a building foundation and by frequently adjusting the pressure of the fluid in the cylinder in order to perform the levelling.

In a possible application of the method according to the invention levelling with a non-curable fluid will be replaced by a substitution of the core of a non-curable fluid with a core of a curable fluid as soon as a stable situation has been established. Such application of the method may take place in the same cylinders according to the invention. The non-curable fluid will then be substituted successively by a curable fluid, the curable fluid under the same pressure as the non-curable fluid being let out of the cylinder simultaneously with the curable fluid being let into the cylinder. A curable casting material will constitute a preferred fluid to establish right from the start a core according to the method according to the invention.

The method utilises the possibility of building up a sufficient but not too great a pressure of a fluid in a cylinder and maintaining this pressure in the cylinder. In this manner it is ensured that the support will not settle as the fluid has been cured under pressure and at the same time assure that the foundation pile will not sink during pumping of the fluid into the cylinder and during curing of the fluid under pressure. The pressure may correspond to the pressure that the foundation means, such as a foundation pile, has previously been exposed to, e.g. from a building structure via the foundation of the structure.

In the following, a curable casting material will be used as an example of a fluid for building a core in the cylinder, a building foundation will be used as an example of a structure with a carrier surface, and a foundation pile will be used as an example of a foundation means with a carrier surface. These examples, however, shall not constitute a limitation in the possibilities of exercising the method according to the invention nor a limitation in the possibilities of using the apparatus according to the invention.

The method is very quick in use since it merely requires providing of a carrier surface on the upper part of the foundation pile, perhaps by initial removal of the upper part of the foundation pile, subsequent positioning of cylinder, and finally filling and curing of a casting material. Even if the carrier capacity of the foundation pile is reduced, it has turned out that in many cases it is not necessary to support the foundation while the upper part of the foundation pile is removed and until the new support has been established.

In a preferred embodiment of an apparatus according to the invention the apparatus is characterised in that the cylinder is provided with an inlet and an outlet, that the inlet is provided in the bottom piston, that the outlet is provided in the top piston, and that the inlet is provided with a valve and a manometer.

Providing an inlet for casting mass in the bottom piston or the top piston and an outlet for air in the opposite piston, it is possible with the inlet to fill casting mass into the cylinder and, if required, to replenish the cylinder with casting mass, and it is possible with the outlet to control when the cylinder has been filled with casting mass. The inlet of the preferred embodiment is provided with a valve and a manometer. With a manometer and a valve it is possible to adjust the pressure to a value corresponding e.g. to the pressure to which the foundation pile has previously been exposed, respectively replenish the cylinder with supplemental casting mass if the casting mass shrinks while curing. Among other things it is important that the foundation pile is not exposed to a pressure larger than the pressure to which the foundation pile has previously been exposed since there will then be a risk that the foundation pile may sink.

The cylinder may be provided with a pressure accumulator in order to compensate for any compression or weighing down that may occur, e.g. of a foundation pile when the foundation pile becomes loaded. A pressure accumulator may e.g. consist of one or more rubber elements that will become compressed when the curable casting material is pumped into the cylinder. After the casting material has been pumped into the cylinder, and until the casting material has cured completely, a certain amount of time will pass. Providing a pressure accumulator it is possible to outweigh or at least reduce any pressure reduction in the cylinder resulting from compression or weighing down, e.g. of a foundation pile, during the time span until the casting material has been cured completely.

The cylinder may be lined with a stocking, which may be made impermeable by a moisture-proof medium, a corrosion-restraining medium or other medium such that moisture, corrosive substances or other substances detrimental to the casting material will not be able to penetrate into the cured casting mass. After the casting material has cured, a possibility of removing the cylinder around the cured casting mass may be established. The cylinder may be assembled from several cylinder parts, which contact each other along propellers of the cylinder. Alternatively, the cylinder may be maintained around the casting material after it has cured, without removing the cylinder.

The building structure to be supported may be the foundation of a house, a foundation of a bridge or other kinds of building structures. The foundation means is usually a wooden foundation pile, but it may also be a foundation pile of a different material, in which the upper part of the foundation pile no longer possess sufficient carrier capacity.

DESCRIPTION OF THE DRAWINGS

The invention will now be described in further detail with reference to the accompanying drawing, wherein

FIG. 1 is an outline of an arrangement for use in application of the method. The figure illustrates an existing foundation 1 for a building structure (not shown) and a foundation means in the form of an existing wooden sub foundation pile 2. The sub foundation pile 2 has had an extension up to a carrier surface 3 on the existing foundation 1, but an upper part (not shown) has been removed. The upper part has been removed after an initial excavation around the sub foundation pile 2 under the existing foundation 1. The upper part has been situated over the groundwater level 4. The remaining part of sub foundation pile 2 is situated under the groundwater level 4 and extends down under the surface of a ground 5.

Figure 1:
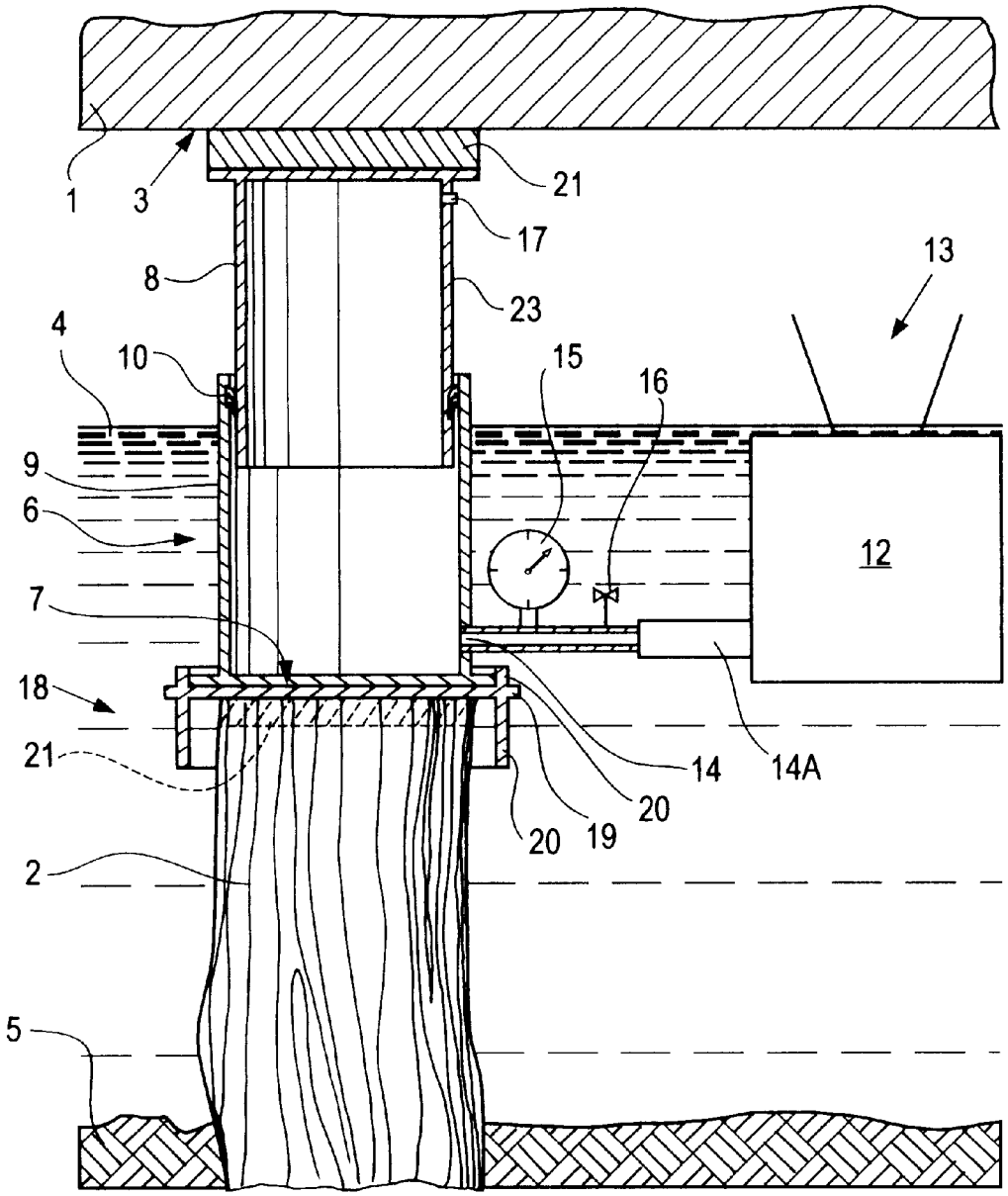
FIG. 1 is an outline of an application of the method according to the invention.

After the upper part has been removed, a cylinder 6 is introduced between a carrier surface 7 on the remaining sub foundation pile 2 and the carrier surface 3 on the existing foundation 1. The cylinder 6, which is shown in a sectional view, constitutes a part of an apparatus according to the invention and comprises a top piston 8 and a bottom piston 9. Mounted between the top piston 8 and the bottom piston 9 is a sealing device 10 which, in the embodiment shown, comprises a sealing element in the form of a lip-like or labial seal. The top piston 8 and the bottom piston 9 may be displaced telescopically in relation to one another.

The bottom piston 9 is provided with an inlet 14 of a curable casting material (not shown), which is intended to be pumped under pressure into the cylinder 6. The inlet 14 is in connection with a pump 12 for pumping the casting material. The pump is provided with a funnel 13 for filling casting material. Between the inlet 14 and the pump 12 a pipeline 14*a* is provided having a manometer 15 and a valve 16. The manometer 15 is designed to measure the pressure under which the casting material is pumped into the cylinder 6. The valve 16 is designed to shut off the inlet and outlet of casting material to and from the cylinder 6.

The top piston 8 is provided with an outlet 17 for air inside the cylinder 6. When the casting material is let into the cylinder through the inlet 11 in the bottom piston 9, it is necessary that air contained in the cylinder 6 is able to escape from the cylinder 6 in order for the cylinder to be filled with casting material. As long as air escapes through the outlet 17 while casing material is being filled into the cylinder 6, the outlet 17 is open. When air no longer exits through the outlet 17, the cylinder 6 has been filled completely with casting material, and the outlet 17 is closed.

Arranged between the bottom piston 9 and the carrier surface 7 on the sub foundation pile 2 is a support plate 18. The support plate 18 comprises a plate 19 contacting the carrier surface 7 and flanges 20 extending substantially perpendicularly to the plate 19. The flanges 20 extend around the sub foundation pile 2 and around the bottom piston 9. The support plate 18 ensures that the cylinder 6 does not skid on the carrier surface 7 during application of the method according to the invention.

Arranged between the top piston 8 and the carrier surface 3 on the existing foundation 1 in the embodiment shown is a cushioning means in the forms of a pillow 21 of ground-moist concrete. The pillow 21 of ground-moist concrete ensures that sufficient contact will be established between the top piston 8 and the carrier surface 3 on the existing foundation 1 when the casting material is pumped into the cylinder 6. As an alternative to, or a supplement to, the pillow 21 of ground-moist concrete there may be arranged a number of other cushioning means, such as pressure accumulators between the top piston 8 and the carrier surface 3 on the existing foundation 1. Pressure accumulators may be advantageous in cases where the sub foundation pile 2 sinks slightly after the casting material has been pumped into the cylinder 6. The pillow 21 of ground-moist concrete and/or pressure accumulators may alternatively be arranged between the bottom piston 9 and the carrier surface 7 on the sub foundation pile 2.

The pump 12 is a pump of a known type for pumping a casting material, such as a mortar pump, e.g. for pumping special mortar for use as a casting material.

Figure 2:
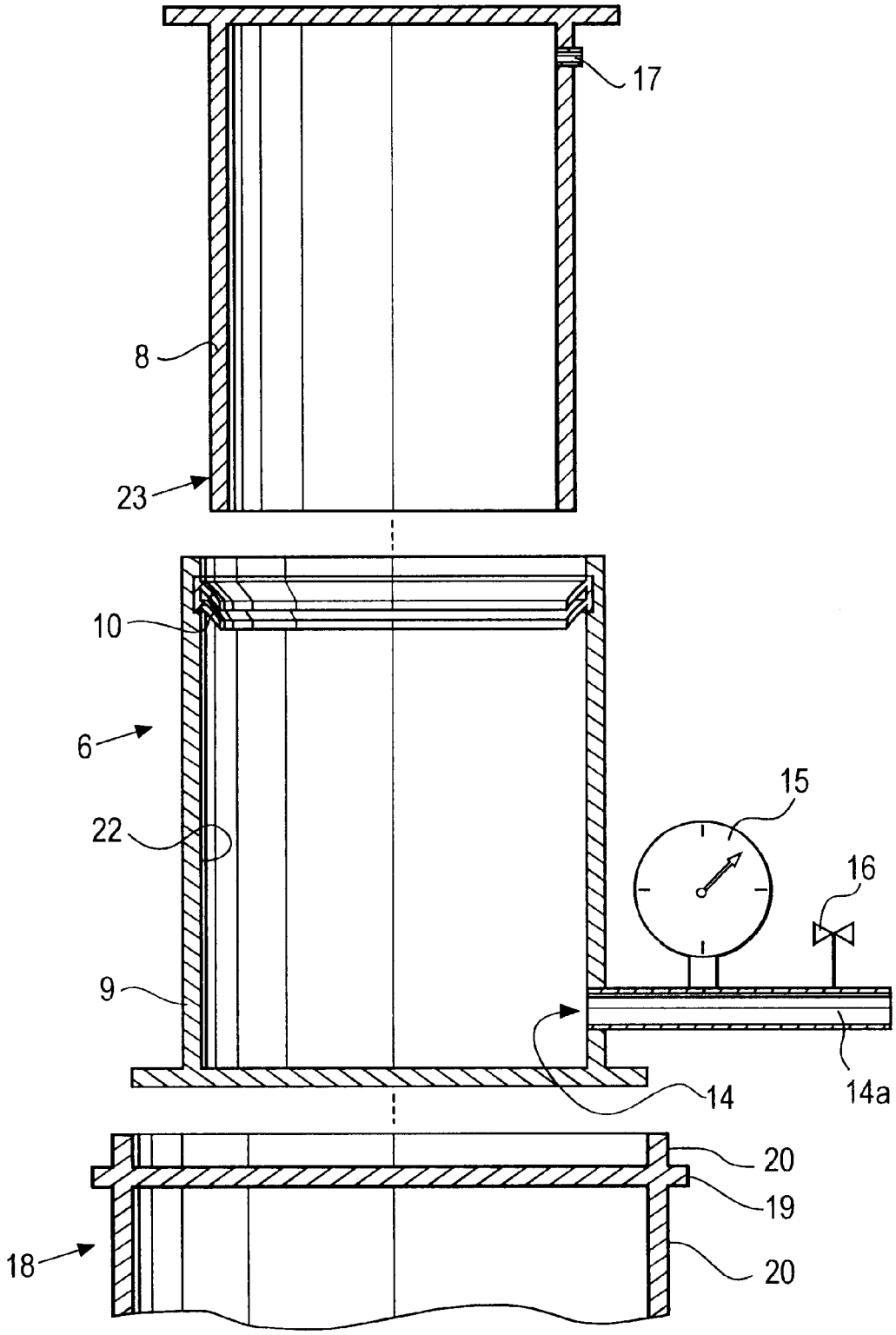
FIG. 2 is an outline of a first embodiment of a cylinder for an apparatus according to the invention.

FIG. 2 is a sectional view through a first embodiment of an apparatus according to the invention. The apparatus is similar to the one shown in FIG. 1 and thus comprises the cylinder 6 with the top piston 8 and the bottom piston 9. The top piston 8 and the bottom piston 9 in the illustration shown are separated from each other and are telescopically displaceable in relation to one another. The sealing device 10, which is a labial or lip-like seal in the illustration shown, is provided along an inner side 22 of the bottom piston 9 and is intended to contact an outer side 23 of the top piston 8. The inlet 14 is positioned at the bottom of the bottom piston 9. The inlet 14 is provided with the pipeline 14*a* having the manometer 15 and the valve 16. The support plate 18 is shown under the bottom piston 9.

Figure 3:
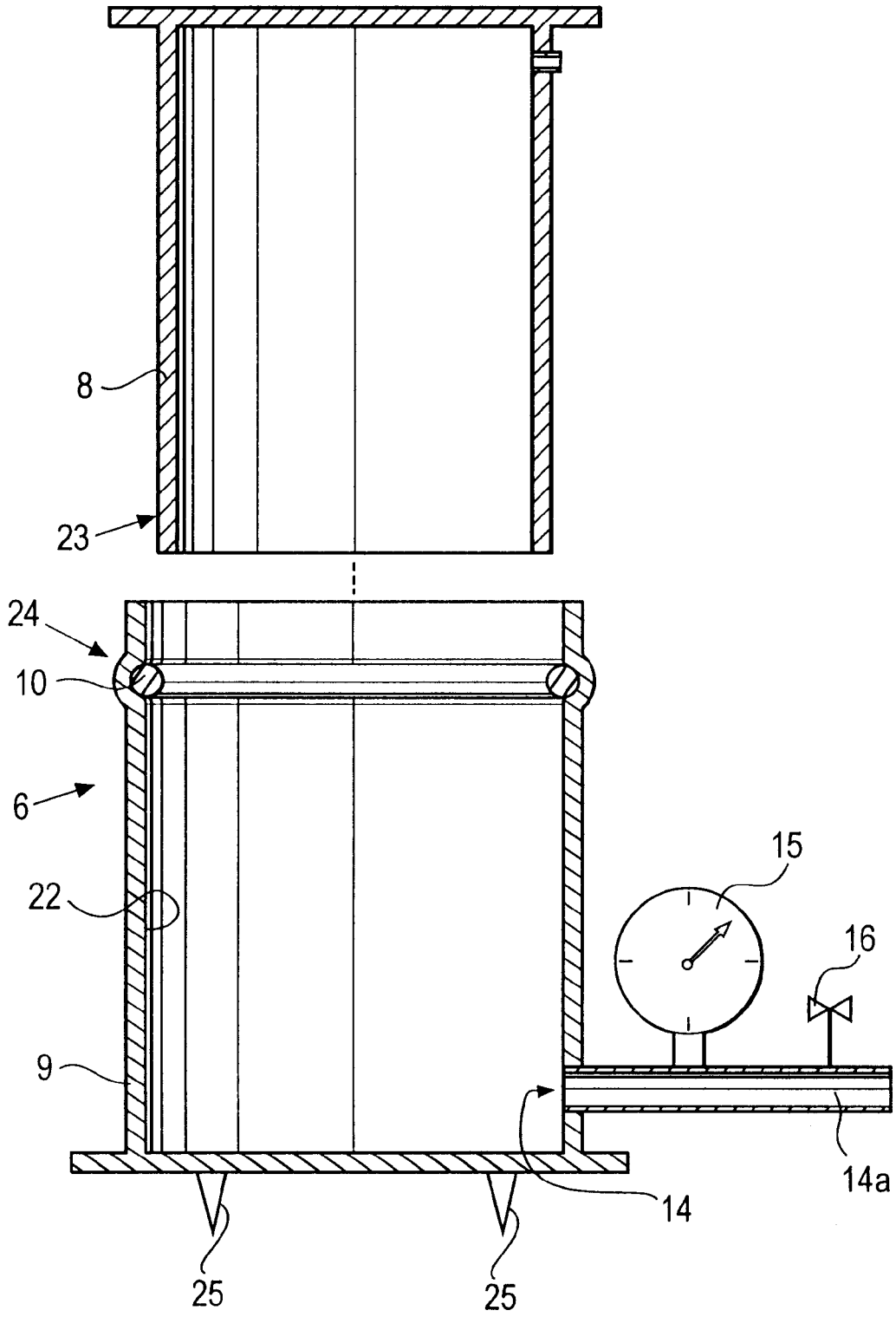
FIG. 3 is an outline of a second embodiment of a cylinder for an apparatus according to the invention.

FIG. 3 is a sectional view through a second embodiment of an apparatus according to the invention. The apparatus in FIG. 3 also comprises a cylinder 6 having a top piston 8 and a bottom piston 9. The top piston 8 and the bottom piston 9 in the embodiment shown are also separated from each other and telescopically displaceable in relation to one another. A sealing device 10, which is an O-ring sealing in the embodiment shown, is provided in a track 24 along an inner side 22 of the bottom piston 9 and is intended to contact an outer side 23 of the top piston 8. Improved sealing may be obtained by providing more O-rings in other tracks. The inlet 14 is provided with the pipeline 14*a*having the manometer 15 and the valve 16. The bottom piston 9 is provided with catching members in the form of spikes 25, which extend downward and which are intended to engage with the carrier surface 7 on the sub foundation pile 2, the spikes 25 being displaced down into the carrier surface 7 on the sub foundation pile 2. In this manner it is not necessary to arrange the support plate 18 (see FIG. 1) between the bottom piston 9 and the carrier surface 7.

Figure 4:
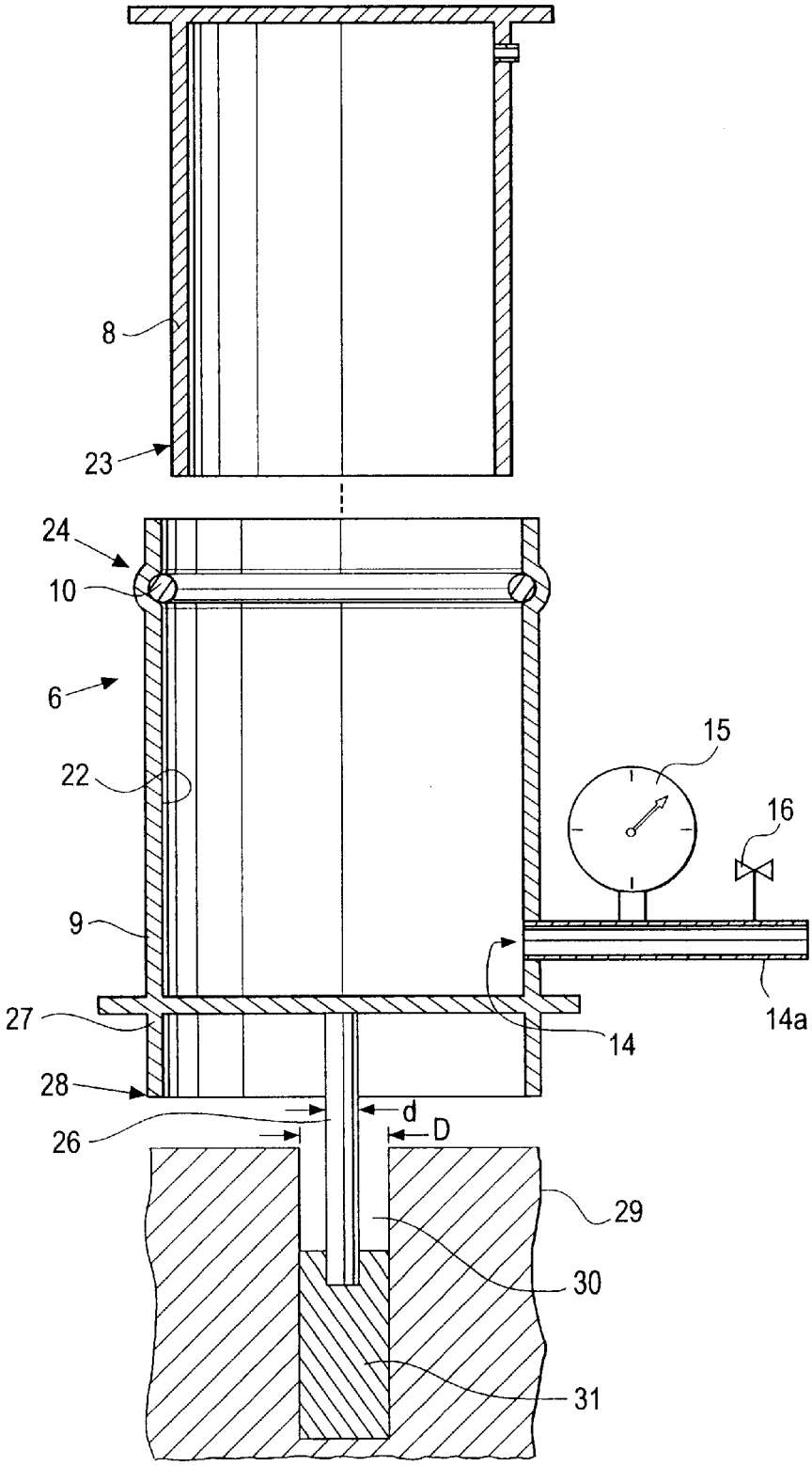
FIG. 4 is an outline of a third embodiment of a cylinder for an apparatus according to the invention.

FIG. 4 is a sectional view through a third embodiment of an apparatus according to the invention. The top piston 8 is similar to the top piston 8 shown in the preceding figures. The bottom piston 9, however, is provided with means for establishing a moment-stable joint between the bottom piston 9 and the sub foundation pile 2. The moment-stable joint is established partly by means of a pin 26 mounted substantially in the centre under the bottom piston 9 and extending downward from the bottom piston 9, and partly by means of a flange 27 mounted along the circumference of the bottom piston 9 and likewise extending downward from the bottom piston 9. The flange 27 is provided with a bevel 28 enabling the flange 27 to cut down into an edge 29 of the sub foundation pile 2.

Before the apparatus is placed on top of the sub foundation pile 2, a hole 30 is bored in the top of the sub foundation pile 2 to receive the pin 26. The hole 30 has a diameter D that is larger than a diameter d of the pin. After boring the hole 30 is filled with a fluent curable material 31, e.g. corresponding to the one filled into the cylinder 6. The cylinder 6 with the top piston 8 and the bottom piston 9 is positioned on the carrier surface 7 of the sub foundation pile 2 so that the pin 26 extends partially into the hole 30. Then curable casting material is pumped into the cylinder 6. When the curable casting material is pumped into the cylinder, the pin 26 will be displaced downward into the hole 30 as a result of the pressure in the cylinder while the flange 27 will cut its way into the edge 29 of the sub foundation pile 2. The curable material 31, which has initially been filled into the hole 30, will form a contacting means between the pin 26 and the hole 30. Thus, the moment-stable joint between the bottom piston 9 and the remaining sub foundation pile 2 is established when the pin 26 has bee secured in the hole 30 and the flange 27 has cut its way into the edge 29 of the sub foundation pile 2.

The invention has been described above with reference to a specific application of the method according to the invention and with reference to specific embodiments of an apparatus according to the invention. Other embodiments may be provided, however, and different applications of the method described may be performed. In the illustrated embodiment of the apparatus it consists of a bottom piston and a top piston. It will be possible to provide further intermediate pistons or telescopic links extending between the bottom piston and the top piston and being telescopically displaceable in relation to one another and in relation to the bottom piston and the top piston.

What is claimed is:

1. A method for laying a foundation for an existing building structure, said method comprising the steps of: excavating a space under an existing foundation; removing an upper part of an existing foundation pile after excavation to provide a carrier surface on a remaining sub-foundation pile; establishing a core between the carrier surface on the remaining sub-foundation pile and a carrier surface on the existing foundation by means of a cylinder; wherein the core between the carrier surface on the existing foundation and the carrier surface of the sub-foundation pile is a cast core; introducing to said cylinder a fluid for establishing the cast core formed of a curable casting material, the curable casting material being supplied to said cylinder under pressure; filling the cylinder with the curable casting material under pressure so that pressure of the fluid is established in the cylinder until a top piston and a bottom piston housed in said cylinder are situated in respective support positions, and curing the casting material, wherein the cylinder is arranged between the carrier surface on the sub-foundation pile and the carrier surface on the existing foundation with said top piston being directed towards the carrier surface on the existing foundation and said bottom piston being directed towards the carrier surface on the sub-foundation pile, so that when a fluid under pressure is let into the cylinder, the cylinder is filled with the fluid under pressure until the top piston is in contact with the carrier surface on the existing foundation and until the bottom piston is in contact with the carrier surface on the sub-foundation pile; said pressure established in the cylinder being greater than the gravitational pressure of the building structure on the sub-foundation pile so that the sub-foundation pile is able to assimilate such pressure without sinking.

2. A method according to claim 1, wherein a pillow of ground-moist concrete is placed between the top piston and the carrier surface of the existing foundation.

3. A method according to claim 1 wherein pressure accumulator means are arranged either between the top piston and the carrier surface on the existing foundation, or between the bottom piston and the carrier surface on the sub-foundation means.

4. A method according to claim 1 wherein engagement members are provided between the bottom piston and the carrier surface on the sub-foundation for establishment of non-skid joint, and moment-stable joint, between the cylinder and the sub-foundation means.

* * * * *